US010415846B2

(12) United States Patent
Okochi

(10) Patent No.: US 10,415,846 B2
(45) Date of Patent: Sep. 17, 2019

(54) AIR-CONDITIONING APPARATUS

(71) Applicant: Mitsubishi Electric Corporation, Tokyo (JP)

(72) Inventor: Kazuki Okochi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 4 days.

(21) Appl. No.: 15/539,876

(22) PCT Filed: Jan. 23, 2015

(86) PCT No.: PCT/JP2015/051913
§ 371 (c)(1),
(2) Date: Jun. 26, 2017

(87) PCT Pub. No.: WO2016/117126
PCT Pub. Date: Jul. 28, 2016

(65) Prior Publication Data

US 2017/0370608 A1 Dec. 28, 2017

(51) Int. Cl.
*F25B 13/00* (2006.01)
*F25B 5/02* (2006.01)
(Continued)

(52) U.S. Cl.
CPC ..... *F24F 11/89* (2018.01); *F24F 11/30* (2018.01); *F24F 11/72* (2018.01); *F24F 11/76* (2018.01);
(Continued)

(58) Field of Classification Search
CPC .... F25B 2400/75; F25B 2400/13; F25B 1/00; F25B 5/02; F25B 13/00; F25B 45/00;
(Continued)

(56) References Cited

U.S. PATENT DOCUMENTS

2016/0252284 A1* 9/2016 Kibo ..... F24F 11/30 62/115
2017/0082334 A1* 3/2017 Kawagoe ..... F25B 1/00

FOREIGN PATENT DOCUMENTS

JP 2008-249259 A 10/2008

OTHER PUBLICATIONS

International Search Report of the International Searching Authority dated Apr. 28, 2015 for the corresponding international application No. PCT/JP2015/051913 (and English translation).
(Continued)

*Primary Examiner* — Melvin Jones
(74) *Attorney, Agent, or Firm* — Posz Law Group, PLC

(57) ABSTRACT

An air-conditioning apparatus includes a control unit performing liquid refrigerant equalization control for correcting an imbalance in liquid refrigerant amount between accumulators. The control unit includes a first liquid refrigerant equalization control unit controlling an output of a fan to perform the liquid refrigerant equalization control and a second liquid refrigerant equalization control unit controlling a frequency of a compressor to perform the liquid refrigerant equalization control. The second liquid refrigerant equalization control unit determines an increase or reduction in frequency of the compressor so that a total refrigerant circulation amount is not below a predetermined amount. When a value is within a predefined acceptable range, the control unit selects the first liquid refrigerant equalization control unit to perform the liquid refrigerant equalization control. When the value is outside the acceptable range, the control unit selects the second liquid refrigerant equalization control unit to perform the liquid refrigerant equalization control.

7 Claims, 3 Drawing Sheets

(51) Int. Cl.

| | |
|---|---|
| ***F24F 11/89*** | (2018.01) |
| ***F24F 11/72*** | (2018.01) |
| ***F24F 11/76*** | (2018.01) |
| ***F24F 11/30*** | (2018.01) |
| ***F25B 40/06*** | (2006.01) |
| ***F25B 45/00*** | (2006.01) |
| *F24F 110/10* | (2018.01) |
| *F25B 1/10* | (2006.01) |
| *F25B 9/00* | (2006.01) |
| *F25B 49/02* | (2006.01) |

(52) U.S. Cl.

CPC ..... *F25B 5/02* (2013.01); *F25B 13/00* (2013.01); *F25B 40/06* (2013.01); *F25B 45/00* (2013.01); *F24F 2110/10* (2018.01); *F25B 1/10* (2013.01); *F25B 9/008* (2013.01); *F25B 49/022* (2013.01); *F25B 2313/0233* (2013.01); *F25B 2400/06* (2013.01); *F25B 2700/2106* (2013.01); *F25B 2700/21152* (2013.01)

(58) Field of Classification Search

CPC .. F24F 11/89; F24F 11/72; F24F 11/76; F24F 11/30; F24F 2100/10

See application file for complete search history.

(56) References Cited

OTHER PUBLICATIONS

Office Action dated Dec. 5, 2017 issued in corresponding JP patent application No. 2016-570461 (and English translation).

* cited by examiner

AIR-CONDITIONING APPARATUS

CROSS REFERENCE TO RELATED APPLICATION

This application is a U.S. national stage application of International Application No. PCT/JP2015/051913, filed on Jan. 23, 2015, the contents of which are incorporated herein by reference.

TECHNICAL FIELD

The present invention relates to an air-conditioning apparatus having a refrigeration cycle including a combination of two or more heat source units.

BACKGROUND

To meet demands for a larger capacity, air-conditioning apparatuses including a plurality of heat source units have been developed. Such an air-conditioning apparatus including multiple heat source units may have uneven refrigerant distribution between the heat source units in a heating operation. The uneven refrigerant distribution can be caused by various factors. An air-conditioning apparatus has recently been developed to correct (equalize) uneven distribution of liquid refrigerant between heat source units (refer to Patent Literature 1, for example).

As described in Patent Literature 1, controlling an operating output of a fan that sends air to a heat-source-side heat exchanger included in each heat source unit regulates the degree of superheat of refrigerant flowing from the heat-source-side heat exchanger and the degree of superheat of the refrigerant discharged from a compressor to a predetermined value, thus achieving liquid refrigerant equalization control (refer to Patent Literature 1).

PATENT LITERATURE

Patent Literature 1: Japanese Unexamined Patent Application Publication No. 2008-249259

In the liquid refrigerant equalization control in Patent Literature 1, the operating output of the fan for supplying air to the heat-source-side heat exchanger in each heat source unit is controlled to achieve liquid refrigerant equalization. The air flow rate through the fan is necessary to be reduced or increased. When the air flow rate is reduced, a compressor suction pressure is reduced, resulting in a reduction in circulation amount of refrigerant. Unfortunately, air-conditioning capacity may be reduced during the liquid refrigerant equalization control depending on the extent to which the air flow rate is reduced.

As described above, the air-conditioning capacity is difficult to be maintained while the liquid refrigerant equalization control is performed by controlling only the fan.

SUMMARY

The present invention has been made to solve the above-described problem and is intended to provide an air-conditioning apparatus capable of maintaining the air-conditioning capacity during the liquid refrigerant equalization control.

An embodiment of the present invention provides an air-conditioning apparatus including a plurality of heat source units each including a compressor, a heat-source-side heat exchanger, an accumulator, and a fan configured to supply air to the heat-source-side heat exchanger, an imbalance detection unit configured to detect an imbalance in liquid refrigerant amount between the accumulators, a heat exchange amount calculation unit configured to calculate a total heat exchange amount in the heat-source-side heat exchangers, and a control unit configured to, when the imbalance detection unit detects an imbalance, perform liquid refrigerant equalization control to correct the imbalance. The control unit includes a first liquid refrigerant equalization control unit configured to control an output of the fan to perform the liquid refrigerant equalization control and a second liquid refrigerant equalization control unit configured to control a frequency of the compressor to perform the liquid refrigerant equalization control. The control unit is configured to select the first liquid refrigerant equalization control unit to perform the liquid refrigerant equalization control when a value calculated by the heat exchange amount calculation unit is within a predefined acceptable range, and select the second liquid refrigerant equalization control unit to perform the liquid refrigerant equalization control when the value calculated by the heat exchange amount calculation unit is outside the acceptable range.

The embodiment of the present invention can provide an air-conditioning apparatus capable of maintaining the air-conditioning capacity during the liquid refrigerant equalization control.

DETAILED DESCRIPTION

Embodiment 1

Figure 1:
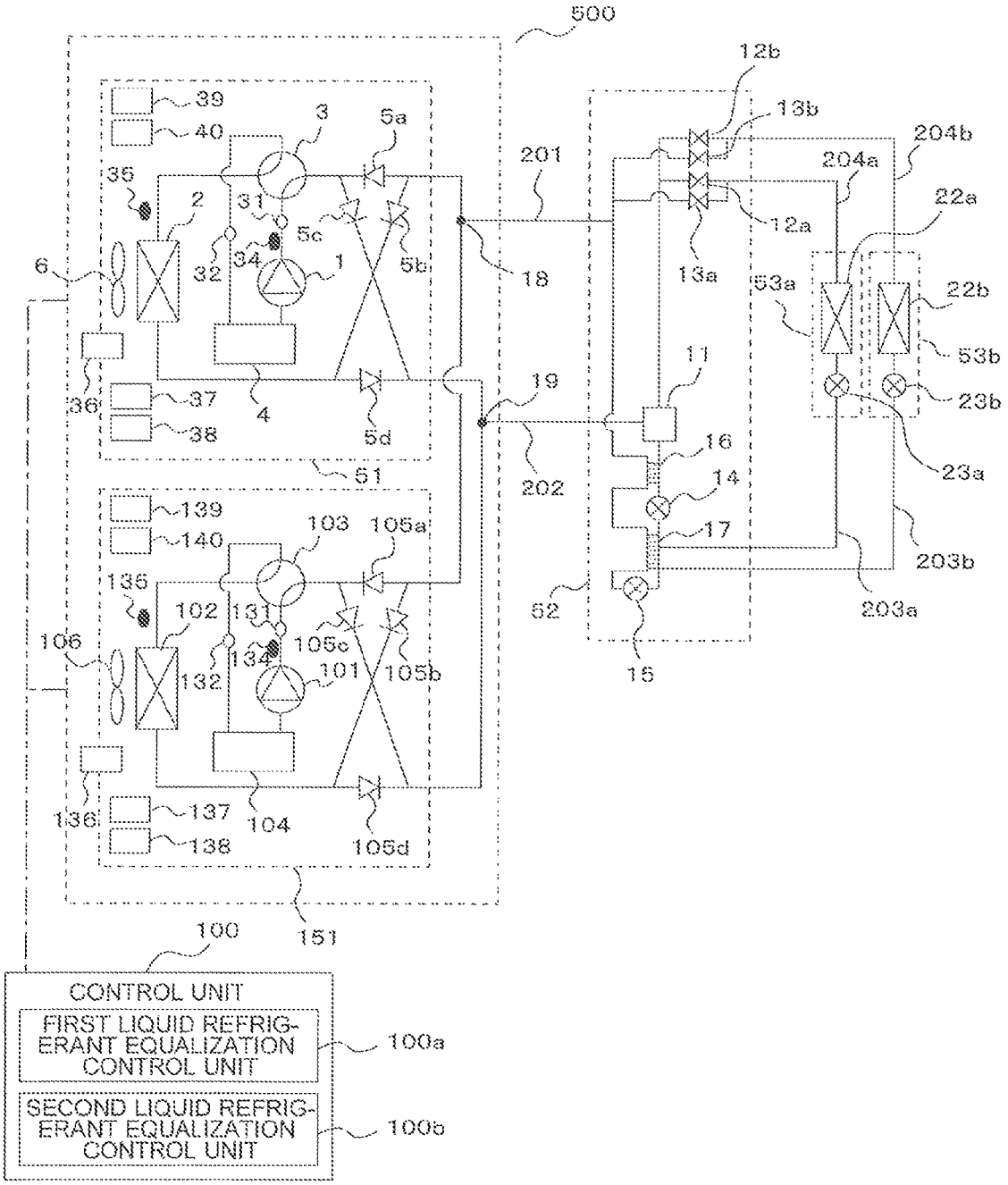
FIG. 1 is a refrigerant circuit diagram illustrating a refrigerant circuit of an air-conditioning apparatus according to Embodiment 1 of the present invention.

FIG. 1 is a refrigerant circuit diagram illustrating a refrigerant circuit of an air-conditioning apparatus according to Embodiment 1 of the present invention. A circuit configuration of an air-conditioning apparatus 500 will be described below with reference to FIG. 1.

The air-conditioning apparatus 500 uses a refrigeration cycle (heat pump cycle), through which refrigerant is circulated, to perform a cooling operation and a heating operation. The air-conditioning apparatus 500 of FIG. 1 includes heat source units (a heat source unit 51 and a heat source unit 151), serving as heat source side units. The heat source units include the same functional parts. In the following description, when the heat source units do not have to be distinguished from each other, reference signs without parentheses will be assigned to the functional parts of the heat source unit 51 and reference signs assigned to the functional parts of the heat source unit 151 will be enclosed by parentheses. The configuration of the air-conditioning apparatus 500 of FIG. 1 is intended only to be illustrative. The air-conditioning apparatus 500 may include three or more heat source units. The air-conditioning apparatus 500 may include a plurality of use side units, serving as load side units.

The air-conditioning apparatus 500 includes the two heat source units (heat source units 51 and 151) and two use side units (a use side unit 53*a* and a use side unit 53*b*). The heat source units 51 and 151 are connected in parallel with the two use side units (use side units 53*a* and 53*b*) by low-pressure pipes 201 and high-pressure pipes 202, thus forming a refrigeration cycle.

The heat source unit 51 (151) includes a compressor 1 (101), a heat-source-side heat exchanger 2 (102), a four-way valve 3 (103), an accumulator 4 (104), and check valves 5*a*, 5*b*, 5*c*, and 5*d* (105*a*, 105*b*, 105*c*, 105*d*). The heat source unit 51 (151) further includes a discharge pressure detection unit 31 (131), a suction pressure detection unit 32 (132), a discharge temperature detection unit 34 (134), a heat-exchanger outlet temperature detection unit 35 (135), and an outdoor air temperature detection unit 36 (136).

The four-way valve 3 (103) is connected to a discharge side of the compressor 1 (101). The four-way valve 3 (103) switches a passage through which the refrigerant discharged from the compressor 1 (101) flows between a passage to the heat-source-side heat exchanger 2 (102) and a passage to the use side units (use side units 53*a* and 53*b*). In addition, the four-way valve 3 (103) is connected to the accumulator 4 (104) and sends the refrigerant flowing from the heat-source-side heat exchanger 2 (102) or the use side units (use side units 53*a* and 53*b*) to the accumulator 4 (104).

The air-conditioning apparatus according to Embodiment 1 can perform the cooling operation and the heating operation by switching the four-way valve 3 (103). The four-way valve 3 (103) corresponds to a flow switching device according to the present invention. The flow switching device is not limited to a four-way switching valve. For example, the flow switching device may include a combination of two-way valves.

The air-conditioning apparatus 500 according to Embodiment 1 further includes a flow dividing controller 52, which is located between the heat source unit 51 (151) and the use side units 53 (use side units 53*a* and 53*b*), to control a refrigerant flow. The heat source units 51 (151), the use side units 53 (53*a*, 53*b*), and the flow dividing controller 52 are connected by various kinds of refrigerant pipes. The use side units 53*a* and 53*b* are connected in parallel with each other. For example, when the use side units 53*a* and 53*b* do not have to be distinguished from each other or specified, the suffixes a and b may be omitted in the following description.

For connection by pipes, the heat source unit 51 (151) and the flow dividing controller 52 are connected by the low-pressure pipe 201 and the high-pressure pipe 202. The low-pressure pipe 201 connecting the heat source unit 51 and the flow dividing controller 52 and the low-pressure pipe 201 connecting the heat source unit 151 and the flow dividing controller 52 join at a liquid-side junction 18 and a gas-side junction 19. High pressure refrigerant flows through the high-pressure pipe 202 from the heat source unit 51 to the flow dividing controller 52. Refrigerant at a lower pressure than that of the refrigerant flowing through the high-pressure pipe 202 flows through the low-pressure pipe 201 from the flow dividing controller 52 to the heat source unit 51 (151). In this case, pressure levels (high and low pressures) are not determined on the basis of a reference pressure (value). The pressure levels (including high, intermediate, and low pressures) are represented relative to one another in the refrigerant circuit depending on, for example, pressurization in the compressor 1 (101) and control of opened or closed states (opening degrees) of expansion devices (flow regulating devices).

The flow dividing controller 52 and the use side unit 53*a* are connected by a liquid pipe 203*a* and a gas pipe 204*a*. Similarly, the flow dividing controller 52 and the use side unit 53*b* are connected by a liquid pipe 203*b* and a gas pipe 204*b*. The connection by using the low-pressure pipes 201, the high-pressure pipes 202, the liquid pipes 203 (liquid pipes 203*a* and 203*b*), and the gas pipes 204 (gas pipes 204*a* and 204*b*) allows the refrigerant to flow among the heat source unit 51 (151), the flow dividing controller 52, and the use side units 53, thus forming the refrigerant circuit.

The heat-source-side heat exchanger 2 (102) includes heat transfer tubes through which the refrigerant passes and fins for increasing the area of heat transfer between the refrigerant flowing through the heat transfer tubes and outdoor air to exchange heat between the refrigerant and the air (outdoor air). For example, the heat-source-side heat exchanger 2 (102) acts as an evaporator in the heating operation to evaporate and gasify, for example, the refrigerant, whereas the heat-source-side heat exchanger 2 (102) acts as a condenser in the cooling operation to condense and liquefy, for example, the refrigerant. In some cases, adjustment may be performed to condense the refrigerant to a two-phase gas-liquid mixed state (two-phase gas-liquid state), instead of fully gasifying or liquefying the refrigerant, for example, as in a cooling main operation, which will be described later.

The check valves 5*a*, 5*b*, 5*c*, and 5*d* (105*a*, 105*b*, 105*c*, 105*d*) prevent backflow of the refrigerant, regulates flow of the refrigerant, and permits the refrigerant to flow in one direction in a refrigerant circulation path regardless of an operation mode. The check valve 5*a* (105*a*), which is disposed on a pipe located between the four-way valve 3 (103) and the low-pressure pipe 201, permits the refrigerant to flow from the low-pressure pipe 201 to the four-way valve 3 (103). The check valve 5*b* (105*b*), which is disposed on a pipe located between the heat-source-side heat exchanger 2 (102) and the low-pressure pipe 201, permits the refrigerant to flow from the low-pressure pipe 201 to the heat-source-side heat exchanger 2 (102). The check valve 5*c* (105*c*), which is disposed on a pipe located between the four-way valve 3 (103) and the high-pressure pipe 202, permits the refrigerant to flow from the four-way valve 3 (103) to the high-pressure pipe 202. The check valve 5*d* (105*d*), which is disposed on a pipe located between the heat-source-side heat exchanger 2 (102) and the high-pressure pipe 202, permits the refrigerant to flow from the heat-source-side heat exchanger 2 (102) to the high-pressure pipe 202.

In Embodiment 1, the discharge pressure detection unit 31 (131) and the discharge temperature detection unit 34 (134) are attached to a pipe on the discharge side of the compressor 1 (101). The discharge pressure detection unit 31 (131) measures a pressure of the refrigerant on the discharge side of the corresponding compressor. The discharge temperature detection unit 34 (134) measures a temperature of the refrigerant on the discharge side of the corresponding compressor.

The suction pressure detection unit 32 (132) and the heat-exchanger outlet temperature detection unit 35 (135) are attached to a pipe on a suction side of the compressor 1 (101). The suction pressure detection unit 32 (132) measures a pressure of the refrigerant on an outlet side of the heat-source-side heat exchanger 2 (102) in the heating operation. The heat-exchanger outlet temperature detection unit 35 (135) measures a temperature on the outlet side of the heat-source-side heat exchanger 2 (102) in the heating operation. In other words, the heat-exchanger outlet temperature detection unit 35 (135) measures the temperature of the refrigerant to be sucked into the compressor 1 (101). The air-conditioning apparatus 500 further includes the outdoor air temperature detection unit 36 (136) that measures an ambient temperature of the heat source unit 51 (151).

The discharge temperature detection unit 34 (134), the heat-exchanger outlet temperature detection unit 35 (135), and the outdoor air temperature detection unit 36 (136) each include a temperature sensor, such as a thermistor. The discharge pressure detection unit 31 (131) and the suction pressure detection unit 32 (132) each include a pressure sensor.

The heat source unit 51 (151) further includes a discharge superheat degree calculation unit 37 (137), a heat-exchanger outlet superheat degree calculation unit 38 (138), a heat exchange amount calculation unit 39 (139), and a circulation amount calculation unit 40 (140). These calculation units can be each configured by hardware, such as circuit devices that achieve a corresponding calculation functions, or can be each configured by an arithmetic device, such as a microcomputer and a CPU, and software running on the arithmetic device. The discharge superheat degree calculation unit 37, the discharge superheat degree calculation unit 137, the heat-exchanger outlet superheat degree calculation unit 38, and the heat-exchanger outlet superheat degree calculation unit 138 constitute an imbalance detection unit according to the present invention. The imbalance detection unit detects an imbalance in liquid refrigerant amount between the accumulators 4 and 104.

The calculation units will be described below.

The discharge superheat degree calculation unit 37 (137) calculates the degree of superheat on the discharge side of the compressor 1 (101), or a discharge superheat degree TdSH1 (TdSH2) on the basis of a discharge pressure measured by the discharge pressure detection unit 31 (131) and a discharge temperature Td1 (Td2) measured by the discharge temperature detection unit 34 (134) using Equation (1) (Equation (2)).

$$TdSH1=Td1-Tc1 \tag{1}$$

$$TdSH2=Td2-Tc2 \tag{2}$$

Tc1 [degrees C.]: Saturation temperature converted from the discharge pressure measured by the discharge pressure detection unit 31

Tc2 [degrees C.]: Saturation temperature converted from the discharge pressure measured by the discharge pressure detection unit 131

In the following description, the compressor discharge superheat degree will be indicated by TdSH.

The heat-exchanger outlet superheat degree calculation unit 38 (138) calculates the degree of superheat on the outlet side of the heat-source-side heat exchanger 2 (102), or an outlet superheat degree HEXSH1 (HEXSH2) on the basis of a suction pressure measured by the suction pressure detection unit 32 (132) and a temperature Thex1 (Thex2) measured by the heat-exchanger outlet temperature detection unit 35 (135) by using Equation (3) (Equation (4)).

$$HEXSH1=Thex1-Te1 \tag{3}$$

$$HEXSH2=Thex2-Te2 \tag{4}$$

Thex1 [degrees C.]: Saturation temperature converted from the suction pressure measured by the suction pressure detection unit 32

Thex2 [degrees C.]: Saturation temperature converted from the suction pressure measured by the suction pressure detection unit 132

In the following description, the heat-exchanger outlet superheat degree will be indicated by HEXSH.

The heat exchange amount calculation unit 39 (139) calculates the amount of heat exchanged by the heat-source-side heat exchanger 2 (102), or a heat exchange amount AK1 (AK2) by using Equation (5) (Equation (6)).

$$AK1=C1\times Q1 \tag{5}$$

$$AK2=C2\times Q2 \tag{6}$$

AK1 [kW]: Amount of heat exchanged by the heat-source-side heat exchanger 2

AK2 [kW]: Amount of heat exchanged by the heat-source-side heat exchanger 102

C1: Predetermined coefficient related to the capacity of the heat-source-side heat exchanger 2

C2: Predetermined coefficient related to the capacity of the heat-source-side heat exchanger 102

Q1 [kW]: Output of a fan 6

Q2 [kW]: Output of a fan 106

The circulation amount calculation unit 40 (140) calculates the amount of refrigerant circulated in the heat source unit 51 (151), or a refrigerant circulation amount Gr1 (Gr2) by using Equation (7) (Equation (8)).

$$Gr1[\mathrm{kg/h}]=Ps1\times F1 \tag{7}$$

$$Gr2[\mathrm{kg/h}]=Ps2\times F2 \tag{8}$$

Ps1 [MPa]: Pressure measured by the suction pressure detection unit 32

Ps2 [MPa]: Pressure measured by the suction pressure detection unit 132

F1 [Hz]: Compressor output of the compressor 1

F2 [Hz]: Compressor output of the compressor 101

The air-conditioning apparatus 500 further includes a control unit 100 that controls the entire air-conditioning apparatus 500. The control unit 100 obtains values calculated by the discharge superheat degree calculation unit 37 (137), the heat-exchanger outlet superheat degree calculation unit 38 (138), the heat exchange amount calculation unit 39 (139), and the circulation amount calculation unit 40 (140). The control unit 100 performs various control operations, for example, liquid refrigerant equalization control for correcting an imbalance in liquid refrigerant amount between the accumulators 4 and 104 and control of the four-way valve 3 (103) associated with switching between the cooling operation and the heating operation, on the basis of the obtained calculated values.

The control unit 100 can be configured by hardware, such as circuit devices that achieve functions of the control unit, or can be configured by an arithmetic device, such as a microcomputer and a CPU, and software running on the arithmetic device. Each of the discharge superheat degree calculation unit 37 (137), the heat-exchanger outlet superheat degree calculation unit 38 (138), the heat exchange amount calculation unit 39 (139), and the circulation amount calculation unit 40 (140) may be one of functions of the control unit 100.

A functional configuration of the control unit 100 will be described below. The control unit 100 includes, as units that perform the liquid refrigerant equalization control, a first liquid refrigerant equalization control unit 100*a* that controls the output of the fan 6 (106) to correct an imbalance in liquid refrigerant amount and a second liquid refrigerant equalization control unit 100*b* that controls a frequency of the compressor 1 (101) to correct an imbalance in liquid refrigerant amount. The liquid refrigerant equalization control using these liquid refrigerant equalization control units 100*a* and 100*b* will be described in detail later.

Operation modes used by the air-conditioning apparatus 500 according to Embodiment 1 include cooling operations and heating operations. The cooling operations include a cooling only operation, in which all of use side units performing air-conditioning perform cooling, and a cooling main operation, which is a cooling and heating mixed operation with a large cooling load. The heating operations include a heating only operation, in which all of use side units performing air-conditioning perform heating, and a heating main operation, which is a cooling and heating mixed operation with a large heating load.

The flow dividing controller 52 in Embodiment 1 will be described below. The flow dividing controller 52 includes a gas-liquid separator 11 that separates the refrigerant flowing from the high-pressure pipe 202 into gas refrigerant and liquid refrigerant. A gas phase portion (not illustrated), from which the gas refrigerant flows, is connected to flow-dividing-side on-off valves 12 (12*a*, 12*b*), each of which is a solenoid valve. A liquid phase portion (not illustrated), from which the liquid refrigerant flows, is connected to a refrigerant-to-refrigerant heat exchanger 16.

Each of the flow-dividing-side on-off valves 12 (12*a*, 12*b*) and the flow-dividing-side on-off valves 13 (13*a*, 13*b*) is opened or closed corresponding to the operation mode. The flow-dividing-side on-off valves 12 (12*a*, 12*b*) are connected at an end to the gas-liquid separator 11 and are connected at the other end to the gas pipes 204 (204*a*, 204*b*). The flow-dividing-side on-off valves 13 (13*a*, 13*b*) are connected at an end to the gas pipes 204 (204*a*, 204*b*) and are connected at the other end to the low-pressure pipe 201. The flow-dividing-side on-off valves 12 (12*a*, 12*b*) and the flow-dividing-side on-off valves 13 (13*a*, 13*b*) are used in combination and the combination of the valves is appropriately changed to another combination so that the refrigerant flows from the use side units 53 to the low-pressure pipe 201 or from the gas-liquid separator 11 to the use side units 53 corresponding to the operation mode. In this case, the flow-dividing-side on-off valves 12 and the flow-dividing-side on-off valves 13 are used to switch between refrigerant flow directions. For example, a three-way valve may be used to switch between the refrigerant flow directions.

An expansion device 14 is disposed between the refrigerant-to-refrigerant heat exchanger 16 and a refrigerant-to-refrigerant heat exchanger 17. The opening degree of the expansion device 14 is controlled corresponding to the operation mode, thus regulating the flow rate and pressure of the refrigerant flowing from the gas-liquid separator 11. An expansion device 15 regulates the flow rate and pressure of the refrigerant flowing from the refrigerant-to-refrigerant heat exchanger 17. The refrigerant flowing out of the expansion device 15 subcools the refrigerant in, for example, the refrigerant-to-refrigerant heat exchanger 17 and the refrigerant-to-refrigerant heat exchanger 16 and then flows into the low-pressure pipe 201.

The refrigerant-to-refrigerant heat exchanger 17 includes a high-pressure side passage and a low-pressure side passage and exchanges heat between the refrigerant passing through the high-pressure side passage and the refrigerant passing through the low-pressure side passage. The refrigerant flowing from the expansion device 14 or the refrigerant flowing from the liquid pipes 203*a* and 203*b* passes through the high-pressure side passage. The refrigerant flowing downstream of the expansion device 15 (the refrigerant flowing out of the expansion device 15) passes through the low-pressure side passage. The refrigerant-to-refrigerant heat exchanger 16 similarly includes a high-pressure side passage and a low-pressure side passage and exchanges heat between the refrigerant passing through the high-pressure side passage and the refrigerant passing through the low-pressure side passage. The liquid refrigerant flowing from the gas-liquid separator 11 to the expansion device 14 passes through the high-pressure side passage of the refrigerant-to-refrigerant heat exchanger 16. The refrigerant flowing out of the low-pressure side passage of the refrigerant-to-refrigerant heat exchanger 17 passes through the low-pressure side passage of the refrigerant-to-refrigerant heat exchanger 16.

The configuration of each use side unit 53 (53*a*, 53*b*) will be described below. The use side unit 53 includes a use-side heat exchanger 22 (22*a*, 22*b*) and a use-side expansion device 23 (23*a*, 23*b*) disposed close to and connected in series with the use-side heat exchanger 22. The use-side heat exchanger 22 acts as an evaporator in the cooling operation and acts as a condenser in the heating operation to exchange heat between the refrigerant and air in an air-conditioned space. A fan for efficient heat exchange between the refrigerant and the air may be disposed in the vicinity of the use-side heat exchanger 22.

The use-side expansion device 23, acting as a pressure reducing valve or an expansion valve, regulates the pressure of the refrigerant passing through the use-side heat exchanger 22. A case is assumed where the use-side expansion device 23 in Embodiment 1 includes an electronic expansion valve whose opening degree can be changed. In the cooling operation, the opening degree of the use-side expansion device 23 is determined on the basis of the degree of superheat on a refrigerant outlet side (connected to the gas pipe 204 in this case) of the use-side heat exchanger 22. In the heating operation, the opening degree of the use-side expansion device 23 is determined on the basis of the degree of subcooling on a refrigerant outlet side (connected to the liquid pipe 203 in this case) of the use-side heat exchanger 22.

As described above, the air-conditioning apparatus 500 according to Embodiment 1 having such a configuration can perform any of the four operations (modes): the cooling only operation, the heating only operation, the cooling main operation, and the heating main operation. The refrigerant flow in the heating operation will be described below because uneven refrigerant distribution tends to occur in the heating operation. The refrigerant flow in the cooling operation is not relevant to the scope of the present invention and a description of the refrigerant flow in the cooling operation is accordingly omitted.

Figure 2:
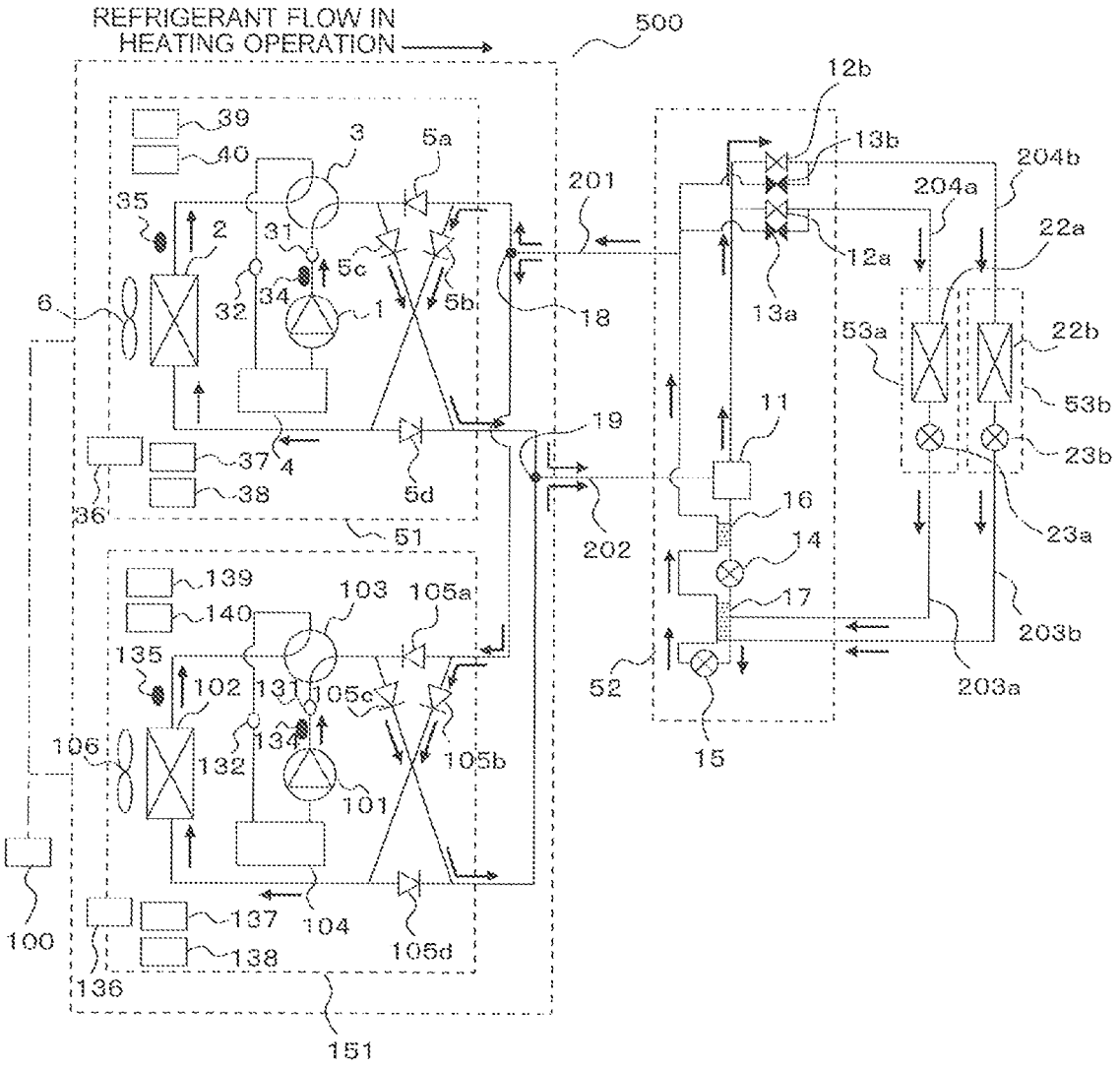
FIG. 2 is a diagram illustrating a refrigerant flow in a heating only operation in the air-conditioning apparatus according to Embodiment 1 of the present invention.

FIG. 2 is a diagram illustrating the refrigerant flow in the heating only operation in the air-conditioning apparatus according to Embodiment 1 of the present invention. Operations of the components and the refrigerant flow in the heating only operation will be described below with reference to FIG. 2. The following description will be on the assumption that all of the use side units 53 perform heating without stopping. The refrigerant flow in the heating only operation is indicated by full-line arrows in FIG. 2. In the heat source unit 51 (151), the compressor 1 (101) compresses sucked refrigerant and discharges high-pressure gas refrigerant. The refrigerant discharged by the compressor 1 (101) flows through the four-way valve 3 (103) and the check valve 5*c* (105*c*) (does not flow to the check valve 5*a* (105*a*) and the check valve 5*d* (105*d*) due to the relationship between refrigerant pressures) and then flows through the high-pressure pipe 202 into the flow dividing controller 52.

In the flow dividing controller 52 in the heating only operation, the flow-dividing-side on-off valves 12 (12*a*, 12*b*) are opened and the flow-dividing-side on-off valves 13 (13*a*, 13*b*) are closed. In addition, the expansion device 14 is fully closed. Consequently, the gas refrigerant that has flowed into the flow dividing controller 52 passes through the gas-liquid separator 11, the flow-dividing-side on-off valves 12 (12*a*, 12*b*), and the gas pipes 204*a* and 204*b* and flows into the use side units 53*a* and 53*b*.

In the use side units 53*a* and 53*b*, the opening degrees of the use-side expansion devices 23*a* and 23*b* are adjusted to adjust the flow rates of the refrigerant flowing through the use-side heat exchangers 22*a* and 22*b*. The high-pressure gas refrigerant, which has flowed into the use-side heat exchangers 22*a* and 22*b*, exchanges heat with the indoor air while passing through the use-side heat exchangers 22*a* and 22*b* to be condensed into liquid refrigerant, and passes through the use-side expansion devices 23*a* and 23*b*. At this time, the heat exchange heats the indoor air, thus heating the air-conditioned space (indoor space).

The refrigerant that has passed the use-side expansion devices 23*a* and 23*b* is, for example, intermediate-pressure liquid refrigerant or two-phase gas-liquid refrigerant. The refrigerant passes through the liquid pipes 203*a* and 203*b*, flows through the refrigerant-to-refrigerant heat exchanger 17, and then passes through the expansion device 15, where the refrigerant is reduced in pressure. The refrigerant flows through a flow-dividing-side bypass pipe 205 to the low-pressure pipe 201 and then flows into the heat source unit 51 (151).

The refrigerant that has flowed into the heat source unit 51 (151) passes through the check valve 5*b* (105*b*) in the heat source unit 51 (151) and flows into the heat-source-side heat exchanger 2 (102). While passing through the heat-source-side heat exchanger 2 (102), the refrigerant exchanges heat with the air to be evaporated into gas refrigerant. The refrigerant passes through the four-way valve 3 (103) and the accumulator 4 (104) and returns to the compressor 1 (101). The refrigerant is then discharged from the compressor 1 (101). The refrigerant is circulated through the above-described path in the heating only operation.

An air-conditioning apparatus including multiple heat source units, like the air-conditioning apparatus 500 according to Embodiment 1, may have uneven refrigerant distribution between the heat source units caused by various factors. The uneven refrigerant distribution correlates with the degree of superheat on a suction side of a compressor (or suction superheat degree at the compressor) and the degree of superheat on a discharge side of the compressor (or the discharge superheat degree at the compressor). Specifically, the suction superheat degree and the discharge superheat degree at the compressor increase as the amount of refrigerant in a heat source unit decreases, whereas the suction superheat degree and the discharge superheat degree at the compressor decrease as the amount of refrigerant in the heat source unit increases.

When the refrigerant is evenly distributed between the heat source units 51 and 151, ideally, the following relationship holds: the discharge superheat degree TdSH1 at the compressor 1 is equal to the discharge superheat degree TdSH2 at the compressor 101. When the amount of refrigerant contained in the heat source unit 51 differs from that in the heat source unit 151, the discharge superheat degree TdSH1 at the compressor 1 will differ from the discharge superheat degree TdSH2 at the compressor 101 depending on the amount of refrigerant contained in the heat source unit 51. For example, when the amount of refrigerant contained in the heat source unit 151 is smaller than that in the heat source unit 51, the relationship of TdSH1 <TdSH2 holds.

In Embodiment 1, the following liquid refrigerant equalization control is performed to correct uneven refrigerant distribution between the heat source units.

(Liquid Refrigerant Equalization Control)

An outline of the liquid refrigerant equalization control in Embodiment 1 will be described below.

The following superheat degree conditions may be satisfied to achieve a desirable state in which the refrigerant flow is divided in proportions suitable for amounts of refrigerant discharged from the compressors 1 and 101. In other words, the discharge superheat degree TdSH1 at the compressor 1 and the discharge superheat degree TdSH2 at the compressor 101 are to be equalized and also the outlet superheat degree HEXSH1 at the heat-source-side heat exchanger 2 and the outlet superheat degree HEXSH2 at the heat-source-side heat exchanger 102 are to be set to a predetermined value or higher.

When the discharge superheat degree at the compressor 1 (101) changes, the outlet superheat degree at the heat-source-side heat exchanger 2 (102) also changes in response to the change of the discharge superheat degree. Embodiment 1 accordingly uses control for, specifically, regulating the discharge superheat degree TdSH1 at the compressor 1 and the discharge superheat degree TdSH2 at the compressor 101 to a predetermined value, as will be described below. The predetermined value may be a value set in advance or a value that varies depending on the discharge superheat degrees TdSH1 and TdSH2 during operation. For the value that varies depending on the discharge superheat degrees TdSH1 and TdSH2 during operation, the discharge superheat degree TdSH1 or TdSH2 at the time when a refrigerant imbalance is detected may be used as a predetermined value. A value between the discharge superheat degree TdSH1 and the discharge superheat degree TdSH2 may be used as a predetermined value.

To satisfy these superheat degree conditions, the operating output of the fan 6 or the fan 106 is increased or reduced to control the outlet superheat degrees HEXSH1 and HEXSH2 and the discharge superheat degrees TdSH1 and TdSH2. Specifically, increasing the operating output of the fan 6 (106) increases the discharge superheat degree TdSH1 (TdSH2) and the outlet superheat degree HEXSH1 (HEXSH2), whereas reducing the operating output of the fan 6 (106) reduces the discharge superheat degree TdSH1 (TdSH2) and the outlet superheat degree HEXSH1 (HEXSH2). This relationship is used to determine whether to increase or reduce the operating output of the fan 6 (106).

When the operating output of the fan 6 (106) is excessively reduced to satisfy the above-described superheat degree conditions, heating capacity is reduced. In contrast, when the operating output of the fan 6 (106) is excessively increased, a noise level at the heat source unit 51 (151) increases. To prevent such problems during liquid refrigerant equalization control, the following control is performed in Embodiment 1.

For a total heat exchange amount AK as the sum of the heat exchange amount AK1 in the heat source unit 51 and the heat exchange amount AK2 in the heat source unit 151, an acceptable range is set in which air-conditioning capacity can be maintained and an increase in noise level can be prevented. While the total heat exchange amount AK as the sum of the heat exchange amount AK1 in the heat source unit 51 and the heat exchange amount AK2 in the heat source unit 151 is within the set acceptable range, the first liquid refrigerant equalization control unit 100*a* is selected to perform liquid refrigerant equalization control using the fan 6 (106). While the total heat exchange amount AK is outside the acceptable range, when the fan 6 (106) is merely controlled to satisfy the above-described superheat degree conditions, a problem, such as a reduction in heating capacity and an increase in noise level, may occur. While the total heat exchange amount AK is outside the acceptable range, consequently, the second liquid refrigerant equalization control unit 100*b* is selected to perform liquid refrigerant equalization control by controlling frequency of the compressor 1.

Specifically, while the total heat exchange amount AK is within or below the acceptable range and the heat exchange amount in the entire air-conditioning apparatus 500 is insufficient, when the operating output of the fan 6 is reduced to reduce the discharge superheat degree TdSH1 so that the discharge superheat degree TdSH1 is regulated to the predetermined value, the suction pressure of the compressor 1 may decrease and cause a reduction in refrigerant circulation amount, leading to insufficient heating capacity. In this case, reducing the operating output of the fan 6 is stopped (the current operating output is maintained) and the liquid refrigerant equalization control is performed by controlling the frequency of the compressor 1 (101) to satisfy the above-described superheat degree conditions, thus correcting uneven refrigerant distribution.

While the total heat exchange amount AK is within or above the acceptable range, when the operating output of the fan 6 is increased to increase the discharge superheat degree TdSH1 so that the discharge superheat degree TdSH1 is regulated to the predetermined value, an excessive increase in operating output of the fan 6 may increase the noise level of the heat source unit 51. In this case, similarly, increasing the operating output of the fan 6 is stopped (the current operating output is maintained) and the liquid refrigerant equalization control is performed by controlling the frequency of the compressor 1 (101) to satisfy the above-described superheat degree conditions, thus correcting uneven refrigerant distribution.

Figure 3:
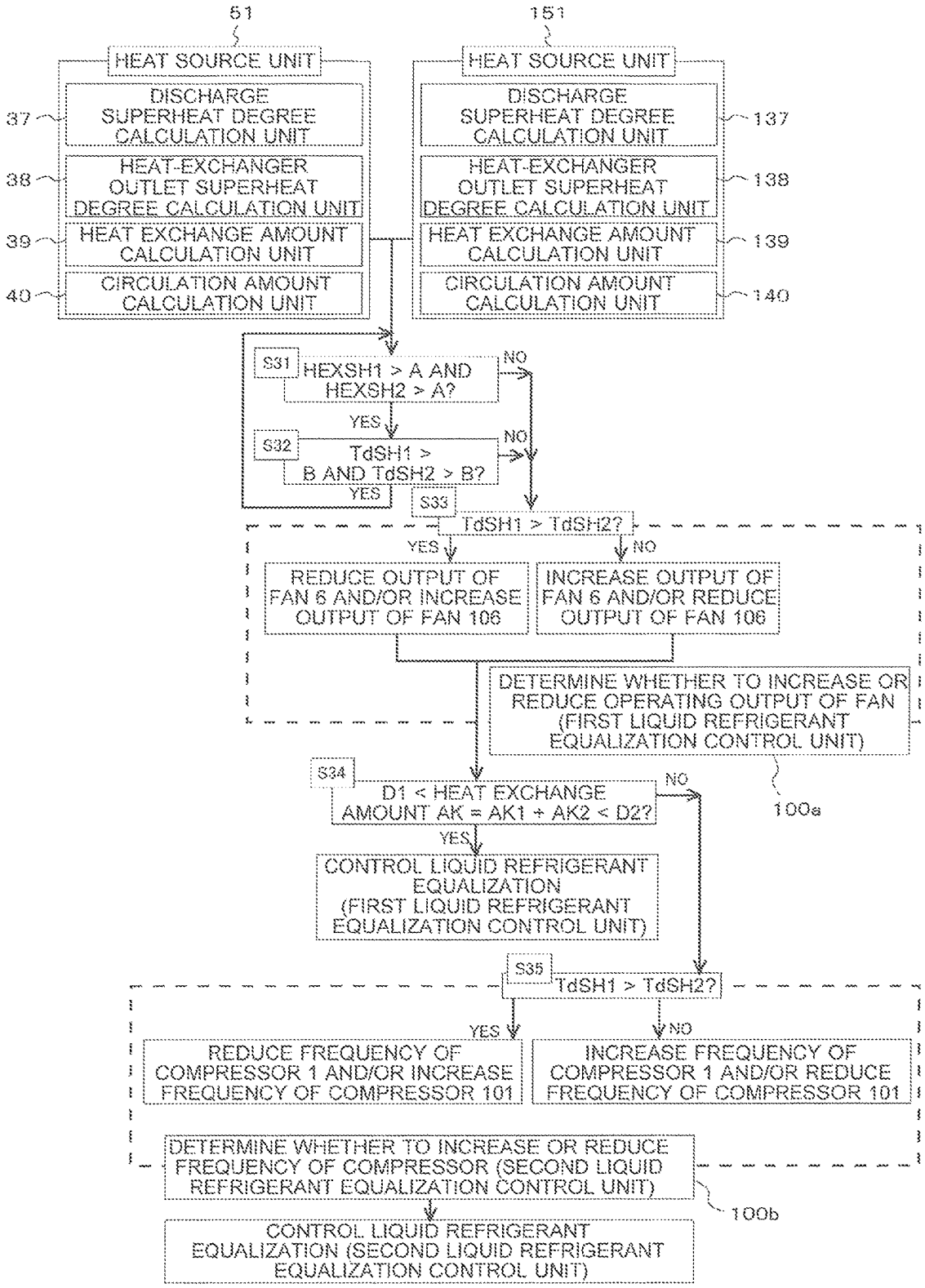
FIG. 3 is a flowchart illustrating control in a heating operation of the air-conditioning apparatus according to Embodiment 1 of the present invention.

FIG. 3 is a flowchart illustrating control in the heating operation of the air-conditioning apparatus according to Embodiment 1 of the present invention.

In the heating operation, the control unit 100 determines whether the outlet superheat degree HEXSH1 obtained by the heat-exchanger outlet superheat degree calculation unit 38 and the outlet superheat degree HEXSH2 obtained by the heat-exchanger outlet superheat degree calculation unit 138 are greater than a value A (hereinafter, "reference value A"), which is a predefined first reference value (S31).

When the control unit 100 determines that each of the outlet superheat degrees HEXSH1 and HEXSH2 is greater than the reference value A, the control unit 100 performs the next determination processing. Specifically, the control unit 100 determines whether the discharge superheat degree TdSH1 obtained by the discharge superheat degree calculation unit 37 and the discharge superheat degree TdSH2 obtained by the discharge superheat degree calculation unit 137 are greater than a value B (hereinafter, "reference value B"), which is a predefined second reference value (S32). When the control unit 100 determines that each of the discharge superheat degrees TdSH1 and TdSH2 is greater than the reference value B (YES in S31 and YES in S32), the control unit 100 returns to S31, in which the same processing is repeated. In this case, the control unit 100 determines that the liquid refrigerant is not imbalanced and continues the normal heating operation.

On the other hand, when the control unit 100 determines that at least one of the outlet superheat degrees HEXSH1 and HEXSH2 is less than or equal to the reference value A (NO in S31) or when the control unit 100 determines that at least one of the discharge superheat degrees TdSH1 and TdSH2 is less than or equal to the reference value B (NO in S32), the control unit 100 determines that the liquid refrigerant is imbalanced and performs the liquid refrigerant equalization control.

The first liquid refrigerant equalization control unit 100*a* compares the discharge superheat degrees TdSH1 and TdSH2 to determine which heat source unit contains a larger amount of liquid refrigerant (S33). When the discharge superheat degree TdSH1 is greater than the discharge superheat degree TdSH2, the first liquid refrigerant equalization control unit 100*a* determines that the heat source unit 151 contains a larger amount of refrigerant. When the discharge superheat degree TdSH1 is less than or equal to the discharge superheat degree TdSH2, the first liquid refrigerant equalization control unit 100*a* determines that the heat source unit 51 contains a larger amount of liquid refrigerant.

The first liquid refrigerant equalization control unit 100*a* determines, on the basis of the result of determination, whether to increase or reduce the operating output of each of the fans 6 and 106 so that the discharge superheat degree TdSH1 at the compressor 1 and the discharge superheat degree TdSH2 at the compressor 101 reach the predetermined value. In this case, the operating outputs of the fans are controlled so that the difference between the discharge superheat degrees TdSH1 and TdSH2 is at or below a predefined reference value, thereby regulating the discharge superheat degrees TdSH1 and TdSH2 to the predetermined value.

When the first liquid refrigerant equalization control unit 100*a* determines in S33 that the discharge superheat degree TdSH1 is greater than the discharge superheat degree TdSH2 and the heat source unit 151 contains a larger amount of liquid refrigerant (YES in S33), the first liquid refrigerant equalization control unit 100*a* determines which of the following manners (a) to (c) is to be used to control the operating outputs of the fans 6 and 106.

(a) Reducing the operating output of the fan 6

(b) Increasing the operating output of the fan 106

(c) Reducing the operating output of the fan 6 and increasing the operating output of the fan 106

(a) Reducing Operating Output of Fan 6

In this case, the amount of heat exchanged by the evaporator in the heat source unit 51 decreases. Consequently, the outlet superheat degree, or quality (dryness) at the heat-source-side heat exchanger 2 decreases and the discharge superheat degree TdSH1 at the compressor 1 also decreases, so that the amount of refrigerant flowing to the heat source unit 51 increases.

(b) Increasing Operating Output of Fan 106

In this case, the amount of heat exchanged by the evaporator in the heat source unit 151 increases. Consequently, the outlet superheat degree, or quality at the heat-source-side heat exchanger 102 increases and the discharge superheat degree TdSH2 at the compressor 101 also increases, so that the amount of refrigerant flowing to the heat source unit 151 decreases.

(c) Reducing Operating Output of Fan 6 and Increasing Operating Output of Fan 106

In this case, the discharge superheat degree TdSH1 at the compressor 1 decreases, whereas the discharge superheat degree TdSH2 at the compressor 101 increases. Thus, the difference between the discharge superheat degrees TdSH1 and TdSH2 decreases.

When the control is performed in any of the manners (a) to (c), the difference between the discharge superheat degree TdSH1 at the compressor 1 and the discharge superheat degree TdSH2 at the compressor 101 decreases, so that the difference of these degrees can be regulated to the predetermined value. This eliminates the uneven liquid refrigerant distribution in which the heat source unit 151 contains a larger amount of liquid refrigerant. In addition, the outlet superheat degree (quality) HEXSH1 and the outlet superheat degree (quality) HEXSH2 also change in response to the changes in discharge superheat degree at the compressors and the difference between the outlet superheat degrees HEXSH1 and HEXSH2 also decreases, so that the difference between these degrees can be reduced to a predetermined value or lower. Any of the manners (a) to (c) for the control is selected depending on setting of the predetermined value. The way of selection is not particularly limited.

On the other hand, when the first liquid refrigerant equalization control unit 100*a* determines in S33 that the discharge superheat degree TdSH1 is less than or equal to the discharge superheat degree TdSH2 and the heat source unit 51 contains a larger amount of liquid refrigerant (NO in S33), the first liquid refrigerant equalization control unit 100*a* determines which of the following manners (a1) to (c1) is to be used to control the operating outputs of the fans 6 and 106.

(a1) Increasing the operating output of the fan 6

(b1) Reducing the operating output of the fan 106

(c1) Increasing the operating output of the fan 6 and reducing the operating output of the fan 106

The amounts of flowing refrigerant in the manners (a1) to (c1) tend to change in the same way as those in the above-described manners (a) to (c). In the manner (a1), the amount of refrigerant flowing to the heat source unit 51 decreases. In the manner (b1), the amount of refrigerant flowing to the heat source unit 151 increases. Any of the manners (a1) to (c1) for the control is selected depending on setting of the predetermined value, similar to the above-described manners (a) to (c). The way of selection is not particularly limited.

Whether to increase or reduce the operating output of each of the fans 6 and 106 is determined as described above.

The control unit 100 causes the heat exchange amount calculation unit 39 (139) to calculate the heat exchange amounts AK1 and AK2 in the heat-source-side heat exchangers 2 and 102 and the total heat exchange amount AK on the basis of operating outputs Q1 and Q2 of the fans 6 and 106 increased or reduced in the manner determined in S33. The control unit 100 determines whether the total heat exchange amount AK is within the set acceptable range. Specifically, the control unit 100 determines whether the total heat exchange amount AK is greater than D1 [kW] and less than D2 [kW] (S34).

When the control unit 100 determines that the total heat exchange amount AK is within the acceptable range, the control unit 100 causes the first liquid refrigerant equalization control unit 100*a* to perform the liquid refrigerant equalization control. Specifically, the liquid refrigerant equalization control is performed by controlling the operating output of the fan 6 (106) on the basis of the increase or reduction in the operating output in the manner determined in S33. On the other hand, when the control unit 100 determines that the total heat exchange amount AK is outside the acceptable range, the control unit 100 determines to perform the liquid refrigerant equalization control through the second liquid refrigerant equalization control unit 100*b*, that is, the liquid refrigerant equalization control by controlling the frequency of the compressor 1 (101).

The second liquid refrigerant equalization control unit 100*b* compares the discharge superheat degrees TdSH1 and TdSH2 to determine which heat source unit contains a larger amount of liquid refrigerant (S35). As this comparison processing is the same as that in S33, the result of comparison in S33 may be used and S35 may be omitted.

The second liquid refrigerant equalization control unit 100*b* determines, on the basis of the result of determination, whether to increase or reduce the frequency of each of the compressor 1 and the compressor 101 so that the discharge superheat degree TdSH1 at the compressor 1 and the discharge superheat degree TdSH2 at the compressor 101 reach the predetermined value. In this case, the frequencies of the compressors 1 and 101 are controlled so that the difference between the discharge superheat degree TdSH1 at the compressor 1 and the discharge superheat degree TdSH2 at the compressor 101 is at or below a predefined reference value, thereby regulating the discharge superheat degrees TdSH1 and TdSH2 to the predetermined value.

When the second liquid refrigerant equalization control unit 100*b* determines in S35 that the discharge superheat degree TdSH1 is greater than the discharge superheat degree TdSH2 (YES in S35), the second liquid refrigerant equalization control unit 100*b* determines which of the following manners (A) to (C) is to be used to control the frequencies of the compressors 1 and 101.

(A) Reducing the frequency of the compressor 1

(B) Increasing the frequency of the compressor 101

(C) Reducing the frequency of the compressor 1 and increasing the frequency of the compressor 101

(A) Reducing Frequency of Compressor 1

When the frequency of the compressor 1 is reduced, the amount of refrigerant discharged from the compressor 1 decreases. In other words, a reduction in frequency of the compressor 1 causes the amount of refrigerant discharged from the compressor 101 to increase relative to the amount of refrigerant discharged from the compressor 1, compared to before the frequency is reduced. For the compressor 1, the amount of refrigerant discharged from the compressor 101 and returning to the compressor 1 increases accordingly. In other words, the amount of refrigerant flowing to the heat source unit 51 increases, so that the discharge superheat degree TdSH1 at the compressor 1 decreases.

(B) Increasing Frequency of Compressor 101

When the frequency of the compressor 101 is increased, the amount of refrigerant discharged from the compressor 101 increases. The amount of refrigerant discharged from the compressor 101 and returning to the compressor 101 decreases accordingly. In other words, the amount of refrigerant flowing to the heat source unit 151 decreases, so that the discharge superheat degree TdSH2 at the compressor 101 increases.

(C) Reducing Frequency of Compressor 1 and Increasing Frequency of Compressor 101

In this case, the discharge superheat degree TdSH1 at the compressor 1 decreases, whereas the discharge superheat degree TdSH2 at the compressor 101 increases. Thus, the difference between the discharge superheat degrees TdSH1 and TdSH2 decreases.

On the other hand, when the second liquid refrigerant equalization control unit 100*b* determines in S35 that the discharge superheat degree TdSH1 is less than the discharge superheat degree TdSH2 (NO in S35), the second liquid refrigerant equalization control unit 100*b* determines which of the following manners (A1) to (C1) is to be used to control the frequencies of the compressors 1 and 101.

(A1) Increasing the frequency of the compressor 1

(B1) Reducing the frequency of the compressor 101

(C1) Increasing the frequency of the compressor 1 and reducing the frequency of the compressor 101

The amounts of flowing refrigerant in the manners (A1) to (C1) tend to change in the same way as those in the above-described manners (A) to (C). In the manner (A1), the amount of refrigerant flowing to the heat source unit 51 decreases. In the manner (B1), the amount of refrigerant flowing to the heat source unit 151 increases.

In Embodiment 1, the second liquid refrigerant equalization control unit 100*b* performs the following determination (not illustrated in the flowchart of FIG. 3) to determine an increase or reduction in frequency of the compressor 1 (101) to perform the liquid refrigerant equalization control by controlling the frequency of the compressor 1 (101) so that the capacity is not excessively reduced. Specifically, the second liquid refrigerant equalization control unit 100*b* causes the circulation amount calculation unit 40 (140) to calculate the refrigerant circulation amount Gr1 in the heat source unit 51, the refrigerant circulation amount Gr2 in the heat source unit 151, and the total refrigerant circulation amount Gr, which is the sum of these amounts. The second liquid refrigerant equalization control unit 100*b* determines an increase or reduction in the compressor 1 (101) so that the total refrigerant circulation amount Gr is not below a predetermined value E to prevent an excessive reduction in capacity.

The above-described processing will be described below specifically. For example, when the discharge superheat degree TdSH1 is greater than the discharge superheat degree TdSH2, the control is performed in any of the above-described manners (A) to (C). A case is assumed where the control is performed in the manner (A) so that the frequency of only the compressor 1 is reduced to reduce the discharge superheat degree TdSH1 to approximate to the discharge superheat degree TdSH2. This control is assumed to be performed, the circulation amount calculation unit 40 (140) calculates the total refrigerant circulation amount Gr. The second liquid refrigerant equalization control unit 100*b* determines whether the total refrigerant circulation amount Gr is below the predetermined value E.

When the total refrigerant circulation amount Gr is below the predetermined value E, this control causes a reduction in capacity. Another control is used accordingly. Specifically, instead of the manner (A) in which the frequency of only the compressor 1 is reduced, the manner (C) in which the frequency of the compressor 1 is reduced and the frequency of the compressor 101 is increased is used for the control. Thus, the liquid refrigerant can be evenly distributed while the capacity is maintained.

As described above, according to Embodiment 1, when the total heat exchange amount AK is outside the acceptable range, the liquid refrigerant equalization control is performed by controlling the frequency of the compressor 1 (101) instead of the liquid refrigerant equalization control by controlling the operating output of the fan 6 (106). Consequently, the liquid refrigerant can be evenly distributed while a reduction in capacity is prevented. In addition, while an increase in noise in the heat source units is also prevented, the liquid refrigerant can be evenly distributed.

In Embodiment 1, control is performed so that the discharge superheat degree TdSH1 and the discharge superheat degree TdSH2 are regulated to the predetermined value. Control may be performed so that the outlet superheat degree HEXSH1 and the outlet superheat degree HEXSH2 are regulated to the predetermined value.

Although the imbalance detection unit according to the present invention includes the discharge superheat degree calculation unit 37, the discharge superheat degree calculation unit 137, the heat-exchanger outlet superheat degree calculation unit 38, and the heat-exchanger outlet superheat degree calculation unit 138 as described above, the imbalance detection unit according to the present invention is not limited to such a configuration for detecting an imbalance on the basis of the discharge superheat degrees and the outlet superheat degrees. For example, the imbalance detection unit may include the discharge superheat degree calculation unit 37 and the discharge superheat degree calculation unit 137 to detect an imbalance on the basis of only the discharge superheat degrees. Alternatively, the imbalance detection unit may include the heat-exchanger outlet superheat degree calculation unit 38 and the heat-exchanger outlet superheat degree calculation unit 138 to detect an imbalance on the basis of only the outlet superheat degrees.

Examples of the refrigerant usable in the refrigeration cycle include, but not limited to, natural refrigerants, such as carbon dioxide, hydrocarbon, and helium, and refrigerants, such as R410A, R32, R4070, R404A, and HFO1234yf.

The configuration of the refrigerant circuit is not limited to the one illustrated herein. In other words, although the refrigerant circuit in Embodiment 1 includes the flow dividing controller 52 in which the liquid refrigerant separated by the gas-liquid separator 11 is allowed to pass through the refrigerant-to-refrigerant heat exchangers 16 and 17, the flow dividing controller 52 may be eliminated. In this case, the gas pipes 204*a* and 204*a* are directly connected to the low-pressure pipe 201 and also the liquid pipes 203*a* and 203*b* are directly connected to the high-pressure pipe 202.

The invention claimed is:

1. An air-conditioning apparatus comprising:

a plurality of heat sources each including a compressor, a heat-source-side heat exchanger, an accumulator, and a fan configured to supply air to the heat-source-side heat exchanger;

an imbalance detector configured to detect an imbalance in liquid refrigerant amount between the accumulators;

a heat exchange amount calculator configured to calculate a total heat exchange amount in the heat-source-side heat exchangers; and a controller configured to, when the imbalance detector detects an imbalance, perform liquid refrigerant equalization control to correct the imbalance, the controller including a first liquid refrigerant equalization controller configured to control an output of the fan to perform the liquid refrigerant equalization control, and a second liquid refrigerant equalization controller configured to control a frequency of the compressor to perform the liquid refrigerant equalization control, the controller being configured to select the first liquid refrigerant equalization controller to perform the liquid refrigerant equalization control when a value calculated by the heat exchange amount calculator is within a predefined acceptable range, and select the second liquid refrigerant equalization controller to perform the liquid refrigerant equalization control when a value calculated by the heat exchange amount calculator is outside the acceptable range.

2. The air-conditioning apparatus of claim 1, further comprising a discharge superheat degree calculator configured to calculate a degree of superheat of refrigerant discharged from the compressor, wherein the liquid refrigerant equalization control is control for regulating the degree of superheat, calculated by the discharge superheat degree calculator, of the refrigerant discharged from the compressor of each of the plurality of heat sources to a predetermined value.

3. The air-conditioning apparatus of claim 2, further comprising:

a pressure detector configured to measure a pressure of the refrigerant on a discharge side of the compressor; and a temperature detector configured to measure a temperature of the refrigerant discharged from the compressor, wherein the discharge superheat degree calculator is configured to calculate the degree of superheat of the refrigerant discharged from the compressor on a basis of a detection value of the pressure detector and a detection value of the temperature detector.

4. The air-conditioning apparatus of claim 1, further comprising an outlet superheat degree calculator configured to calculate a degree of superheat of refrigerant flowing out of the heat-source-side heat exchanger, wherein the liquid refrigerant equalization control is control for regulating the degree of superheat, calculated by the outlet superheat degree calculator, of the refrigerant flowing out of the heat-source-side heat exchanger in each of the plurality of heat source units to a predetermined value.

5. The air-conditioning apparatus of claim 4, further comprising:

a pressure detector configured to measure a pressure of the refrigerant on a suction side of the compressor; and a temperature detector configured to measure a temperature of the refrigerant to be sucked into the compressor, wherein the outlet superheat degree calculator is configured to calculate the degree of superheat of the refrigerant flowing out of the heat-source-side heat exchanger on a basis of a detection value of the pressure detector and a detection value of the temperature detector.

6. The air-conditioning apparatus of claim 1, wherein the imbalance detector is configured to compare a degree of superheat of refrigerant discharged from each of the compressors to a predefined first reference value, compare a degree of superheat of the refrigerant flowing out of each of the heat-source-side heat exchangers to a predefined second reference value, and determine that the refrigerant is imbalanced when at least one of degrees of superheat is less than or equal to the corresponding reference value.

7. The air-conditioning apparatus of claim 1, further comprising a circulation amount calculator configured to calculate a total refrigerant circulation amount in the plurality of heat sources, wherein the second liquid refrigerant equalization controller is configured to determine an increase or reduction in frequency of the compressor so that the total refrigerant circulation amount is not below a predetermined amount to perform the liquid refrigerant equalization control by controlling the frequency of the compressor.

* * * * *